US007574954B2

(12) United States Patent
Lee

(10) Patent No.: US 7,574,954 B2
(45) Date of Patent: Aug. 18, 2009

(54) COMPRESSOR

(75) Inventor: Hyo Jae Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 613 days.

(21) Appl. No.: 10/773,572

(22) Filed: Feb. 9, 2004

(65) Prior Publication Data

US 2005/0175486 A1 Aug. 11, 2005

(51) Int. Cl.
*F01B 31/10* (2006.01)

(52) U.S. Cl. ..... 92/157; 92/158

(58) Field of Classification Search ..... 92/157, 92/158, 159

See application file for complete search history.

(56) References Cited

U.S. PATENT DOCUMENTS 1,959,279 A * 5/1934 Stearns ..... 92/157
2,372,050 A * 3/1945 Barraja-Frauenfelder et al. ..... 92/157
4,831,979 A * 5/1989 DuBois et al. ..... 92/159
5,046,930 A 9/1991 Lindstrom

* cited by examiner

*Primary Examiner*—F. Daniel Lopez
(74) *Attorney, Agent, or Firm*—Ked & Associates LLP

(57) ABSTRACT

A reciprocating compressor is disclosed. The compressor includes a piston mounted to reciprocate inside of a cylinder that draws a working fluid into an inside of the cylinder, compressing, and discharging the working fluid to an outside of the cylinder, a connecting rod connected between a crank shaft and the piston that converts a rotating movement of the crank shaft into reciprocating movement of the piston, a piston pin arranged to pass the cylinder and one end of the connecting rod at the same time, and an oil passage formed to make a clearance between an inside surface of the one end of the connecting rod and an outside surface of the piston pin in communication with an outside of the clearance.

10 Claims, 4 Drawing Sheets

COMPRESSOR

BACKGROUND OF THE INVENTION

1. Field of the Invention

The present invention relates to compressors, and more particularly, to a reciprocating compressor having an improved coupling part structure of a piston and a connecting rod.

2. Background of the Related Art

The compressor boosts a pressure of a working fluid by receiving a power from an electric motor or a turbine, and applying a compressive work to air, refrigerant, or other special gas. The compressor is widely used starting from home appliances, to plant industries in the fields of air conditioners or refrigerators.

Depending on methods of compression, there are positive displacement compressors, and dynamic compressors, or turbo compressors. The positive displacement compressors boost a pressure by reduction of a volume, and have reciprocating compressors, and rotary compressors.

The reciprocating compressor, compressing the working fluid by means of a piston reciprocating inside of a cylinder, is advantageous in that a high compression efficiency can be provided by using comparatively simple mechanical components.

The rotary compressor, compressing the working fluid by means of a roller revolved inside of a cylinder with an eccentricity, can provide a high compression efficiency at a speed lower than the reciprocating compressor.

FIG. 1 illustrates a typical example of the reciprocating compressor, referring to which the reciprocating compressor will be described in more detail.

Referring to FIG. 1, two pieces of cases 1 assembled together form an enclosed space, in which a frame 2 is provided. The frame 2 is supported on the cases 1 with springs 4.

There is a crank shaft 6 mounted passed through a central part of the frame 2. For this, there is a boss 3 in the central part of the frame 2 for stable support of the crank shaft 6.

The crank shaft 6 mounted thus, is rotated by the motor 5, which is provided with a stator 5*a* and a rotor 5*b*. The stator 5*a* is fixed to the frame 2, and the rotor 5*b* is fixed to the crank shaft 6. Since the rotor 5*b* positions inside of the stator 5*a*, the crank shaft 6 rotates together with the rotor 5*b* when power is provided to the motor 5.

Referring to FIG. 1, there is an eccentric pin 6*a* on top of the crank shaft 6 at an eccentric position from a rotation center of the crank shaft 6. There is a balance weight 6*b* on top of the crank shaft at an opposite side of the eccentric pin 6*a*. The balance weight 6*b* prevents the crank shaft 6 from shaking due to weight of the eccentric pin 6*a* during rotation of the crank shaft 6.

In the meantime, there is lubricating oil held on a bottom of the case 1, and the crank shaft 6 has oil passages 6*c* inside of the crank shaft 6. The crank shaft 6 has a pumping device 6*d*, such as a propeller, at a lower end. Accordingly, when the crank shaft 6 rotates, lubricating oil pumped by the pumping device moves following the oil passage 6*c*, and sprayed from the top of the crank shaft 6. According to this, the lubricating oil is supplied to all mechanically operative components in the case 1.

There is a cylinder 10 having a compression chamber 11 therein on top, and in one side part, of the frame 2 (see FIG. 2). There is a piston 15 coupled to the eccentric pin 6*a*, and provided in the compression chamber 1, which will be described in more detail with reference to FIGS. 2 and 3.

Referring to FIG. 1, the cylinder 10 is formed on top of, and as one unit with the frame 2. The piston 15 in the compression chamber 11 reciprocates within the cylinder 10 by the connecting rod 7 when the crank shaft 6 rotates.

For this, the connecting rod 7 has one end, for an example, a big end connected with the eccentric pin 6*a* of the crank shaft 6, and the other end, for an example, a small end 7*a* coupled to the piston 15.

Referring to FIGS. 2 and 3, the small end 7*a* of the connecting rod 7 is coupled to the piston 15 with a piston pin 15*c*. For this, the small end 7*a* of the connecting rod 7 is inserted in a piston chamber 15*a*, a hollow in one side of the piston 15, and the piston pin 15*c* passes through a pin hole 15*b* in the piston 15 and the small end 7*a* at the same time.

According to this, the connecting rod 7 can swing around the piston pin 15*c* within a preset angle, and there is a clearance 'c' between an inside surface of the small end 7*a*, and the outside circumferential surface of the piston pin 15*c*, for the lubricating oil to form a film.

In the meantime, there is a valve assembly 8 at an end of the cylinder 10 for controlling flow of the working fluid, for an example, refrigerant, introduced into the compression chamber 11, compressed, and discharged from the compression chamber 11, and there is a head assembly 9 on the valve assembly 8 for guiding flow of the working fluid.

For reference, the unexplained numeral 12 denotes a suction pipe for introducing refrigerant into the case 1, 13 denotes a suction muffler for attenuating flow noise of the refrigerant introduced through a suction pipe, and 14 denotes a discharge pipe for discharging compressed refrigerant to an outside of the compressor.

In the operation, upon application of power to the motor 5, the rotor 5*b* and the crank shaft 6 rotate, and the rotation of the crank shaft 6 is converted into a linear reciprocating movement of the piston 15 by the connecting rod 7 connected to the eccentric pin 5*b*. Therefore, the refrigerant introduced into the compressor through the suction pipe 12 is compressed by the piston 15 reciprocating in the cylinder 10, and discharged to an outside of the compressor through the discharge pipe 14.

However, the related art compressor has the following problem.

For the rotation of the small end 7*a* of the connecting rod 7 coupled to the piston 15 with the piston pin 15*c* around the piston pin 15*c* within a preset range of angle, supply of lubricating oil to the clearance 'c' is required.

However, referring to FIG. 3, in a compression stroke when the connecting rod 7 presses the piston up to a top dead center, the piston pin 15*c* is pushed toward the connecting rod 7, to leave almost no clearance 'c' and make a pressure of the lubricating oil forming a film in the clearance 'c' suddenly high, which causes cavitation and noise.

Moreover, as the pressure of the lubricating oil inside of the clearance 'c' rises, there is a force for making the lubricating oil to escape from the clearance. In this case, as shown in FIG. 3, the small end 7*a* of the connecting rod 7 is pushed up. According to this, periodical movement of the small end 7*a* of the connecting rod 7 in a length direction of the piston pin 15*c* is occurred, that causes noise.

SUMMARY OF THE INVENTION

Accordingly, the present invention is directed to a compressor that substantially obviates one or more of the problems due to limitations and disadvantages of the related art.

An object of the present invention is to provide a compressor which enables smooth flow of lubricating oil in a clearance between an inside surface of one end of a connecting rod of a compressor and an outside circumferential surface of a piston pin.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the compressor includes a piston mounted to reciprocate inside of a cylinder for drawing a working fluid into an inside of the cylinder, compressing, and discharging the working fluid to an outside of the cylinder, a connecting rod connected between a crank shaft and the piston for converting a rotating movement of the crank shaft into reciprocating movement of the piston, a piston pin arranged to pass the cylinder and one end of the connecting rod at the same time, and an oil passage formed to make a clearance between an inside surface of the one end of the connecting rod and an outside surface of the piston pin in communication with an outside of the clearance.

The oil passage makes the clearance and a piston chamber, a hollow in a bottom end of the piston, in communication.

The oil passage is provided to the piston. In this case, the oil passage is provided to one surface of an inside of the piston the one end of the connecting rod is in contact therewith. Of course, the oil passage is provided to one surface of an inside of the piston the one end of the connecting rod is in contact therewith, and the other surface of the inside of the piston opposite to the one surface of the inside of the piston.

The oil passage is provided to the one end of the connecting rod. In this case, the oil passage is provided to one surface of the one end of the connecting rod in contact with the one surface of the inside of the piston. Of course, the oil passage is provided to one surface of the one end of the connecting rod in contact with one surface of an inside of the piston, and the other surface of the one end of the connecting rod opposite to the one surface of the one end of the connecting rod. The oil passage is provided to pass through the one end of the connecting rod.

A plurality of the oil passage are along a radial direction of the piston.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, the same parts will be given the same names and reference symbols, and repetitive description of which will be omitted.

Figure 1:
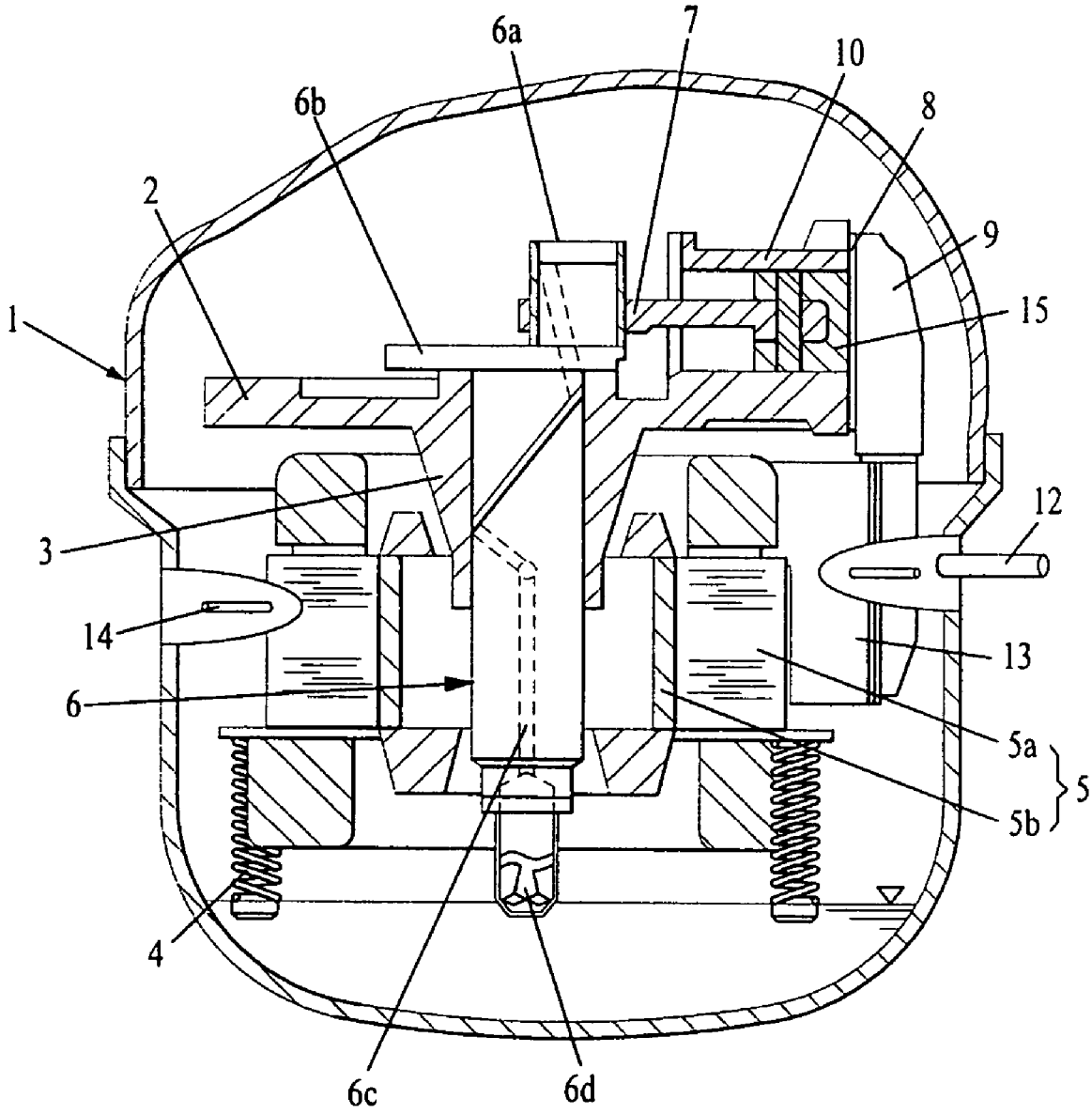
FIG. 1 Prior Art
FIG. 1 illustrates a section of a related art compressor.
Figure 2:
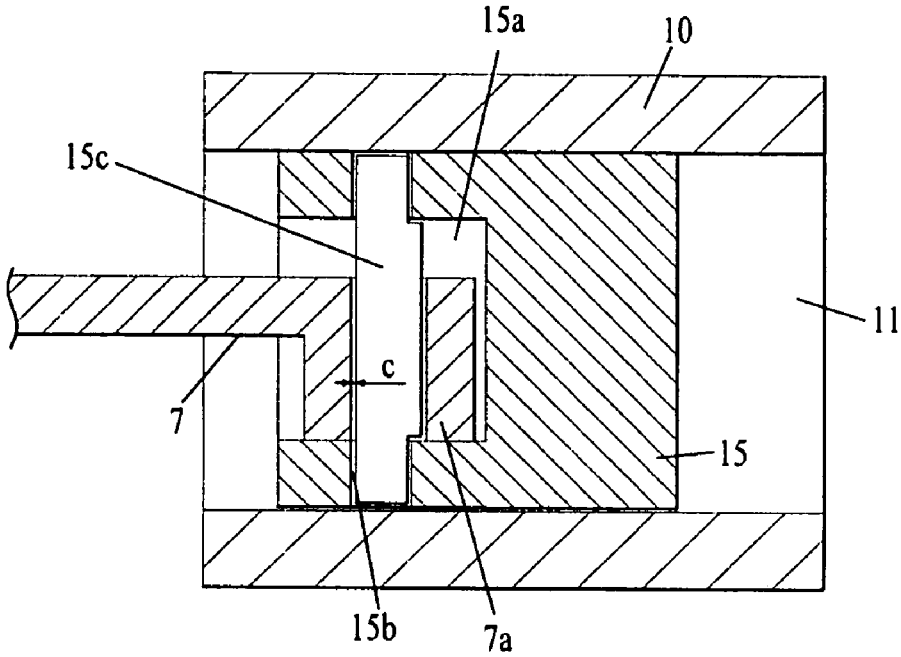
FIG. 2 Prior Art
FIG. 2 illustrates a partial section of the compressor in FIG. 1 showing coupling of a piston and a connecting rod.

A general structure of the compressor of the present invention, for an example, structures of a case for providing an enclosed space therein, a motor in the case, a crank shaft rotated by the motor, a cylinder having a valve assembly, and a head assembly mounted thereon are almost identical to ones described with reference to FIG. 1. Therefore, any further description of those will be omitted, and technical characteristics the compressor of the present invention provides, i.e., a characteristic structure in which the connecting rod is coupled to the cylinder will be described with reference to FIGS. 4~7.

Figure 4:
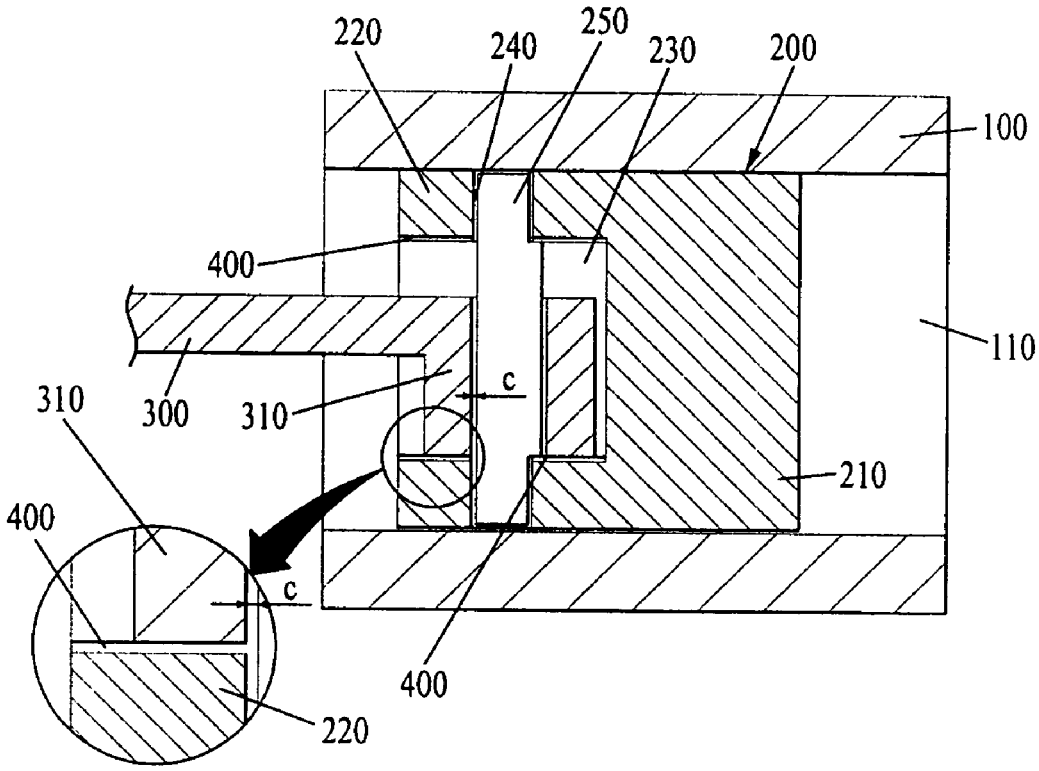
FIG. 4 illustrates a partial section of a compressor in accordance with a first preferred embodiment of the present invention showing coupling of a piston and a connecting rod.

Referring to FIG. 4, a cylinder 100 provided to a frame of a compressor has opened opposite ends, to form a compression chamber 110 therein.

One of the opened ends of the cylinder 100, for an example, the end on a right side part of FIG. 4 has a valve assembly (not shown) and a head assembly (not shown) mounted thereon in succession. The valve assembly controls flow of a working fluid introduced into/discharged from, the compression chamber 110 to an outside of the cylinder 100, and the head assembly guides flow of the working fluid controlled by the valve assembly.

There is a piston 200 in the cylinder 100, with a top end thereof, i.e., a piston head 210 arranged opposite to the one opened end of the cylinder 100 having the valve assembly mounted thereon. Such an arraignment of the piston 200 forms a compression chamber 110 enclosed with the piston head 210, an inside surface of the cylinder 100, and the valve assembly.

In the meantime, there is a skirt 220 extended from a circumference of the piston head 210 opposite to the top of the piston 200. There is a piston chamber 230 inside of the skirt 220 in communication with an outside thereof. According to this, the piston chamber 230 is a hollow in the bottom end of the piston opposite to the top of the piston 200.

Referring to FIG. 4, the skirt 220 has a pin hole 240 making the piston chamber 230 in communication with an outside surface thereof. One end of the connecting rod 300, for an example, the small end 310 is arranged in the piston chamber 230, and the piston pin 250 is arranged to pass through both the cylinder 100 and the small end 310 of the connecting rod 300 at the same time.

The arrangement of the piston pin 250 enables both ends of the piston pin 250 inserted and held in the pin hole 240, with the small end 310 of the connecting rod 300 connected to a middle part of the piston pin 250 inside of the piston chamber 230.

In the meantime, the other end of the connecting rod, for an example, the big end (not shown), opposite to the one end of the connecting rod 300, is connected to the crank shaft that is rotated by a motor (not shown). As described in the related art, the big end is connected to the eccentric pin on the crank shaft arranged eccentric from a rotation axis of the crank shaft.

Therefore, when the motor is operated, to rotate the crank shaft, the connecting rod 300 converts the rotation movement of the crank shaft to a reciprocating movement of the piston 200. Then, while the piston 100 reciprocates in the cylinder 100, the piston 200 draws the working fluid into the compression chamber 110, compresses, and discharges the working fluid to an outside of the cylinder 100.

Thus, the connecting rod 300 converts the rotating movement of the crank shaft into the reciprocating movement of the piston 200. In this process, the piston 200 and the connecting rod 300 make relative movement. That is, the small end 310 of the connecting rod 300 rotates around the piston pin 250 within a preset range of angle.

For this, referring to FIG. 4, there is a clearance 'c' provided between an outside circumferential surface of the piston pin 250 and an inside circumferential surface of one end of the connecting rod 300, i.e., the small end 310. Lubricating oil is supplied to the clearance 'c', so that the lubricating oil forms a lubricating film to make relative movement between the small end 310 and the piston pin 250 smooth.

However, as described in the related art, in a compression stroke, there is almost no clearance 'c', to cause rise of a lubricating oil pressure in the clearance 'c'.

For preventing this, the present invention suggests providing an oil passage 400 for guiding the oil in the clearance 'c' to an outside of the clearance 'c'.

The oil passage 400 is provided such that the clearance 'c' is in communication with an outside of the clearance 'c', for an example, the piston chamber 230, a position and a form of which may vary. A structure of the oil passage 400 will be described in more detail for different embodiments with reference to the attached drawings.

Figure 5:
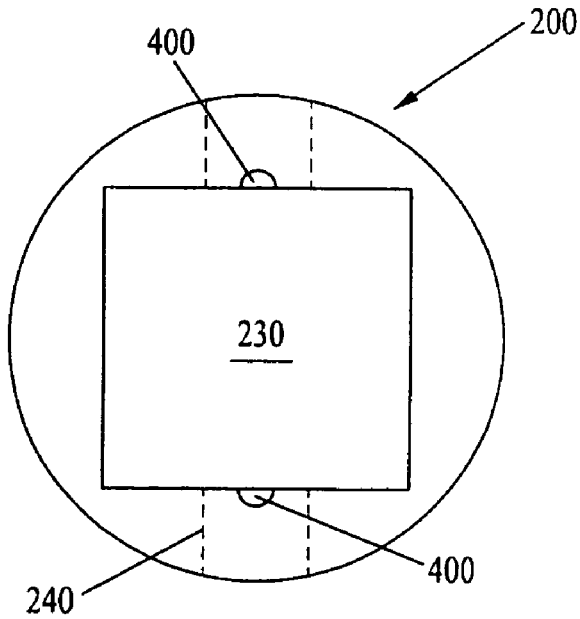
FIG. 5 illustrates a plan view a bottom end of a piston in the compressor in FIG. 4.

Referring to FIGS. 4 and 5, the oil passage 400 is provided to the piston 200 in the compressor in accordance with a first preferred embodiment of the present invention.

For reference, the small end 310 of the connecting rod 300 is in contact with an inside surface of the piston 200 by gravity in a state the small end 310 is arranged in the piston chamber 230.

Therefore, the oil passage 400 is provided in one surface of an inside of the piston 200 in contact with the small end of the connecting rod 300, for an example, a lower surface, so that the lubricating oil in the clearance 'c' escapes from the clearance 'c' to the piston chamber 230 when the lubricating oil has a high pressure applied thereto. In a first preferred embodiment, the oil passage 400 is a groove making the piston chamber 230 in communication with the clearance 'c'.

During a compression stroke when the lubricating oil in the clearance 'c' has a high pressure applied thereto, as shown in FIG. 4, above structure enables the lubricating oil in the clearance 'c' moves down to a lower part of the clearance 'c', and therefrom to the piston chamber 230 along the oil passage 400 provided to the piston 200. Thus, there will be no cavitation or moving up of the small end of the connecting rod 300.

In the meantime, in the first embodiment, the oil passage 400 can be provided not only to one surface of the inside of the piston 200 in contact with the small end 310 of the connecting rod 300, but also the other surface of the inside of the piston 200 opposite to the one surface of the inside of the piston 200. That is, referring to FIG. 5, the oil passage may be provided to the one surface of the inside of the piston 200 in contact with the piston chamber 230, for example, the lower surface, and the other surface of the inside of the piston 200, for an example, an upper surface of the piston 200.

The provision of the oil passages 400 in the one surface, and the other surface of the inside of the piston 200 enables to provide the same effect even in a case the small end 310 of the connecting rod 300 is operated in a state the small end 310 of the connecting rod 300 is moved up. Moreover, it is very convenient in assembly because it is not required to align an assembly direction of the piston 200 and the connecting rod 300.

In the meantime, FIG. 5 illustrates a bottom view of the piston 200. The piston chamber 230 in FIG. 5 has a square section. A form of the piston chamber 230 is not limited to the square section, and may have a variety of forms, such as circular section.

Next, referring to FIGS. 6 and 7, the oil passage 400 may be provided, not to the piston 200, but to the connecting rod 300, which will be described.

Figure 6:
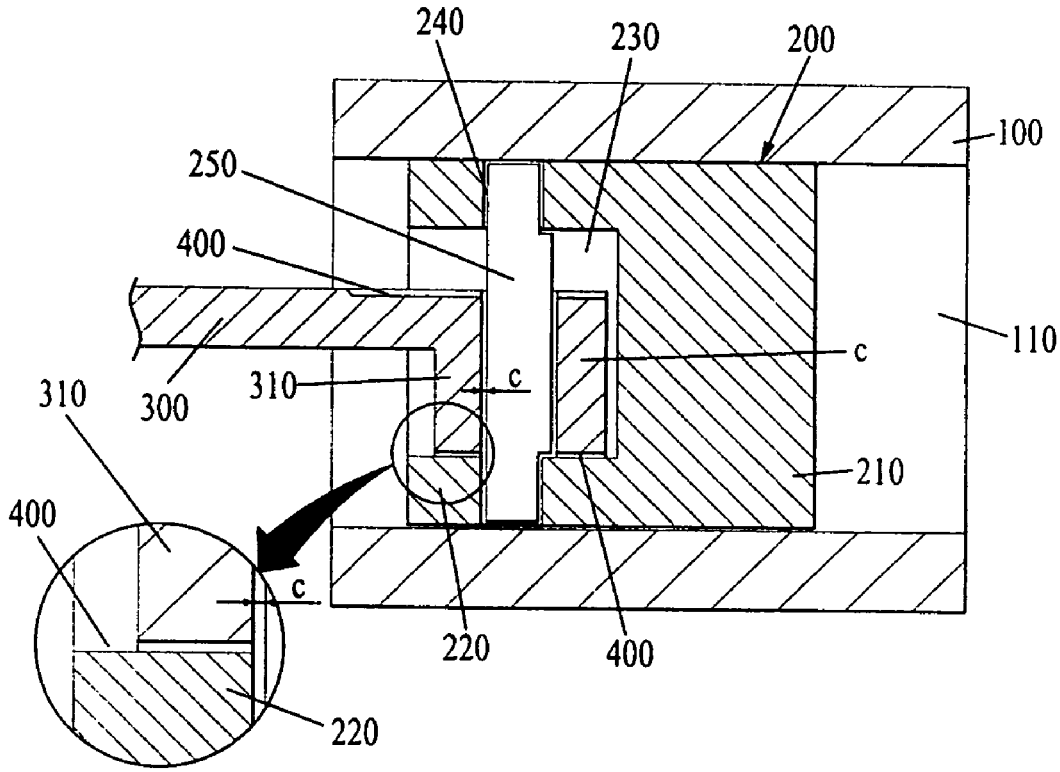
FIG. 6 illustrates a partial section of a compressor in accordance with a second preferred embodiment of the present invention showing coupling of a piston and a connecting rod.

Referring to FIG. 6, the oil passage 400 in a compressor in accordance with a second embodiment of the present invention has a form of groove, provided to one surface, for an example, a lower surface of an end, i.e., a small end 310 of the connecting rod 300 in contact with one surface of an inside of the piston 200.

Of course, the oil passage 400 may be provided, not only to the one surface of the small end 310, but also to the other surface opposite to the one surface of the small end 310, for example, an upper surface. The oil passage 400 in a compressor in accordance with a second embodiment of the present invention has the same operation and effect with the first embodiment.

In the meantime, it is preferable that a plurality of the oil passages 400 are provided along a radial direction of the piston pin 250 in a compressor of the present invention.

Figure 3:
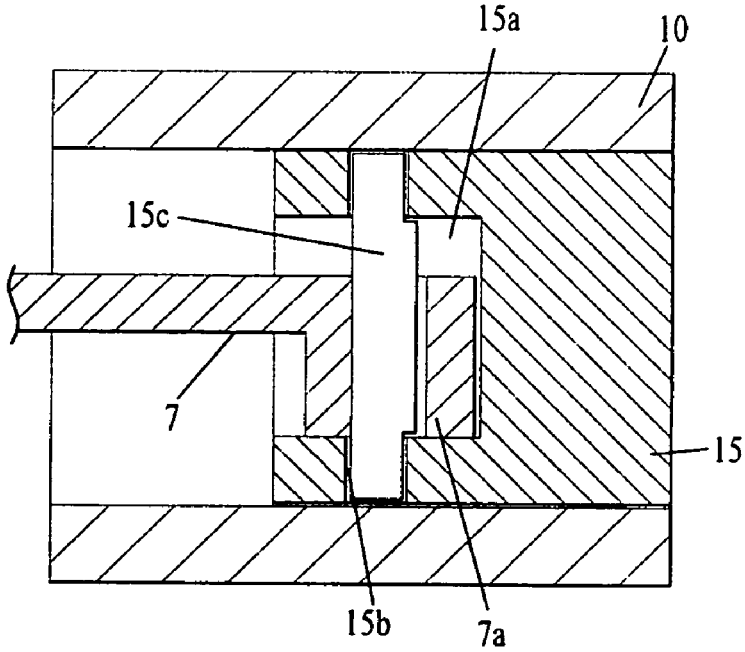
FIG. 3 Prior Art
FIG. 3 illustrates a partial section of the compressor in FIG. 1 for describing a problem taking place in a compression stroke.

Referring to FIG. 3, different from the first or second embodiment of the present invention, the oil passage 400 in accordance with a third preferred embodiment of the present invention has, not a groove form, but a hole form. A hole form of the oil passage 400 is provided to pass through one end of the connecting rod 300, i.e., the small end 310.

Figure 7:
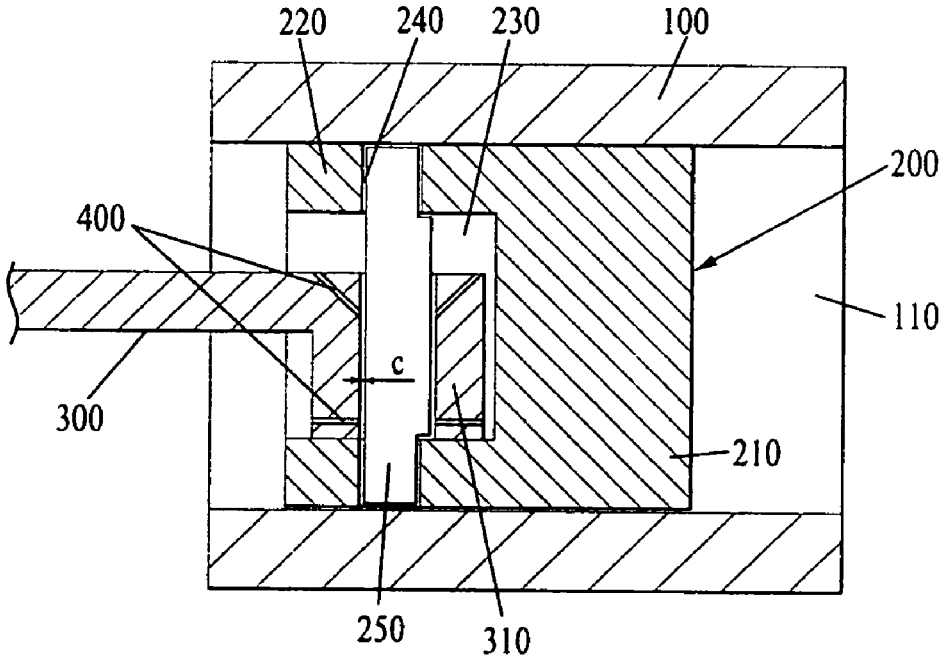
FIG. 7 illustrates a partial section of a compressor in accordance with a third preferred embodiment of the present invention showing coupling of a piston and a connecting rod.

Referring to FIG. 7, a position of the hole form of the oil passage 400 may vary. Because the oil passage 400 is required to provide at a position from which the lubricating oil in the clearance can be discharged to the piston chamber 230, easily.

In the meantime, the operation of the compressor of the present invention is operative as follows.

Upon putting the compressor into operation, the crank shaft is rotated by the motor. Then, the connecting rod converts the rotating movement of the crank shaft into a linear reciprocating movement of the piston 200. According to this, the piston 200 reciprocates in the cylinder 100, to draw the working fluid into the compression chamber 110, compresses, and discharges the working fluid.

During above process, the small end 310 of the connecting rod 300 rotates around the piston pin 250 within a preset range of angle. In this instance, lubricating oil is supplied to the clearance 'c' between an inside surface of the small end 310 and the outside surface of the piston pin 250, for smooth relative movement of the small end 310 and the piston pin 250.

In the meantime, in the compression, the connecting rod 300 pushes the piston 200, or the piston 200 pushes the connecting rod 300. In this case, a part of an inside surface of the small end 310 is brought into close contact with the piston pin 250, to boost a pressure of the lubricating oil inside of the clearance 'c'.

The lubricating oil having a pressure boosted thus escapes to the piston chamber 230 through the oil passage 400 provided to the small end 310 or the piston 200, to maintain the pressure of the lubricating oil inside of the clearance 'c' within a fixed range, always.

Accordingly, not only the cavitation caused by sharp rise of the pressure of the lubricating oil in the clearance 'c', but also the high pressure lubricating oil pushing up the small end 310 of the connecting rod 300, are prevented.

The compressor of the present invention has the following advantages.

First, the appropriate maintenance of a pressure of lubricating oil supplied to a clearance between an inside surface of a small end of a connecting rod and an outside surface of the piston pin permits to prevent cavitation from taking place caused by sharp rise of the pressure of the lubricating oil, thereby preventing excessive noise coming from the cavitation, effectively.

Second, the high pressure lubricating oil in the clearance pushing up the small end of the connecting rod can be prevented, permitting to reduce the noise caused by up/down movement of the small end, as well as wear of the piston pin and the small end.

Third, the provision of the oil passage in an upper surface and a lower surface of an inside surface of the piston, or an upper surface and a lower surface of the small end, disposes of a necessity for alignment of assembly direction of the piston and the connecting rod in assembly of the piston and the connecting rod, to permit easy assembly, with a consequential improvement of productivity.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A compressor, comprising:

a piston mounted to reciprocate inside of a cylinder to draw a working fluid into a compression chamber within the cylinder, compress, and discharge the working fluid to an outside of the cylinder;

a connecting rod connected between a crank shaft and the piston that converts a rotating movement of the crank shaft into a reciprocating movement of the piston;

a piston pin attached to one end of the connecting rod, wherein a clearance is provided between an inside surface of die one end of the connecting rod and an outside surface of the piston pin; and at least one oil passage configured to connect the clearance with a piston chamber, wherein the at least one oil passage is configured to allow lubricating oil to escape from the clearance into the piston chamber, and wherein the at least one oil passage comprises a groove provided extending along an inside surface of the piston.

2. The compressor as claimed in claim 1, wherein the at least one oil passage comprises a plurality of oil passages.

3. A compressor, comprising:

a piston mounted to reciprocate inside of a cylinder to draw a working fluid into a compression chamber within the cylinder, compress, and discharge the working fluid to an outside of the cylinder;

a connecting rod connected between a crank shaft and the piston that converts a rotating movement of the crank shaft into a reciprocating movement of the piston;

a piston pin attached to one end of the connecting rod, wherein a clearance is provided between an inside surface of the one end of the connecting rod and an outside surface of the piston pin; and at least one oil passage configured to connect the clearance with a piston chamber, wherein the at least one oil passage is configured to allow lubricating oil to escape from the clearance into the piston chamber, wherein the at least one oil passage is includes a first oil passage extending along a first inside surface of the piston with which the one end of the connecting rod is in contact, and includes a second oil passage a second inside surface of the piston opposite to the first inside surface.

4. A compressor, comprising:

a piston mounted to reciprocate inside of a cylinder to draw a working fluid into a compression chamber with the cylinder, compress, and discharge the working fluid to an outside of the cylinder;

a connecting rod connected between a crank shaft and the piston that converts a rotating movement of the crank shaft into a reciprocating movement of the piston;

a piston pin attached to one end of the connecting rod, wherein a clearance is provided between an inside surface of the one end of the connecting rod and an outside surface of the piston pin; and at least one oil passage configured to connect the clearance with a piston chamber, wherein the at least one oil passage is configured to allow lubricating oil to escape from the clearance into the piston chamber, and wherein the at least one oil passage is provided in the one end of the connecting rod.

5. The compressor as claimed in claim 4, wherein the at least one oil passage comprises a hole that passes through the one end of the connecting rod.

6. The compressor as claimed in claim 5, wherein the at least one oil passage extends parallel to a central longitudal axis of the connecting rod.

7. The compressor as claimed in claim 5, wherein the at least one oil passage extends at an angle to a central longitudal axis of the connecting rod.

8. The compressor as claimed in claim 4, wherein the one end of the connecting rod comprises a piston pin attaching portion and wherein the at least one oil passage extends a length of the piston pin attaching portion.

9. The compressor as claimed in claim 4, wherein the one end of the connecting rod comprises a piston pin attaching portion and wherein the at least one oil passage extends from an inner surface of the one end adjacent a surface of the piston pin to an outer surface of the piston pin attaching portion opposite the piston pin.

10. The compressor as claimed in claim 4, wherein the at least one oil passage comprises a plurality of oil passages.

* * * * *